US008405449B2

(12) United States Patent
Muza

(10) Patent No.: US 8,405,449 B2
(45) Date of Patent: Mar. 26, 2013

(54) RESETTABLE HIGH-VOLTAGE CAPABLE HIGH IMPEDANCE BIASING NETWORK FOR CAPACITIVE SENSORS

(75) Inventor: John M. Muza, Venetia, PA (US)

(73) Assignee: Akustica, Inc., Pittsburgh, PA (US)

( * ) Notice: Subject to any disclaimer, the term of this patent is extended or adjusted under 35 U.S.C. 154(b) by 132 days.

(21) Appl. No.: 13/040,466

(22) Filed: Mar. 4, 2011

(65) Prior Publication Data

US 2012/0223770 A1 Sep. 6, 2012

(51) Int. Cl.
*G05F 1/10* (2006.01)

(52) U.S. Cl. ..... 327/534; 327/530

(58) Field of Classification Search ..... 327/530, 327/534, 535, 536, 537, 538, 543
See application file for complete search history.

(56) References Cited

U.S. PATENT DOCUMENTS

| | | | | |
|---|---|---|---|---|
| 3,215,859 | A | 11/1965 | Sorchych | |
| 6,975,193 | B2 | 12/2005 | Knieser et al. | |
| 7,756,486 | B1 | 7/2010 | Tan et al. | |
| 7,800,443 | B2 | 9/2010 | Korner et al. | |
| 8,134,375 | B2 * | 3/2012 | Boom | 324/679 |
| 2008/0164888 | A1 | 7/2008 | Suzuki et al. | |
| 2008/0217149 | A1 | 9/2008 | Schmid et al. | |
| 2010/0013501 | A1 | 1/2010 | Van Den Boom | |
| 2010/0246859 | A1 | 9/2010 | David et al. | |

FOREIGN PATENT DOCUMENTS

| | | |
|---|---|---|
| DE | 102004026002 | 12/2005 |
| WO | 2009131749 | 10/2009 |

OTHER PUBLICATIONS

Extended Search Report from the European Patent Office for Application No. 12157070.9 dated Jul. 3, 2012 (8 pages).

* cited by examiner

*Primary Examiner* — Jeffrey Zweizig
(74) *Attorney, Agent, or Firm* — Michael Best & Friedrich LLP

(57) ABSTRACT

A high-voltage MEMS biasing network. The network has a reset mode wherein a capacitive sensor is charged, and a functional mode wherein the MEMS biasing network provides a high impedance between the capacitive sensor and a bias voltage source. The network includes a biasing circuit, a mirror circuit, and a control circuit. The biasing circuit and the mirror circuit have a charging state and a high impedance state. The control circuit includes a first branch that controls the biasing circuit and a second branch that controls the mirror circuit. The biasing network receives a logic control signal, the first branch puts the biasing circuit into the charging state when the logic control signal is a first logic signal, and puts the biasing circuit into the high impedance state when the logic control signal is a second logic signal.

17 Claims, 2 Drawing Sheets

RESETTABLE HIGH-VOLTAGE CAPABLE HIGH IMPEDANCE BIASING NETWORK FOR CAPACITIVE SENSORS

BACKGROUND

The invention relates to a biasing network that is capable of receiving a high biasing voltage (e.g., 100 volts) and transitioning between a low impedance state and a high impedance state based on a low voltage (e.g., 5 volt) logic signal.

Biasing networks for capacitive sensors (e.g., a MEMS capacitive sensor), have a low impedance state and a high impedance state. When the biasing network is in a low impedance state, a biasing current is allowed to flow and charge a sensor capacitor. The biasing network then switches to the high impedance state to stop the flow of current to the sensor capacitor.

SUMMARY

In one embodiment, the invention provides a high-voltage MEMS biasing network. The network has a reset mode wherein a capacitive sensor is charged, and a functional mode wherein the MEMS biasing network provides a high impedance between the capacitive sensor and a bias voltage source. The network includes a biasing circuit, a mirror circuit, and a control circuit. The biasing circuit and the mirror circuit have a charging state and a high impedance state. The control circuit includes a first branch that controls the biasing circuit and a second branch that controls the mirror circuit. The biasing network receives a logic control signal, the first branch puts the biasing circuit into the charging state when the logic control signal is a first logic signal, and puts the biasing circuit into the high impedance state when the logic control signal is a second logic signal.

In another embodiment the invention provides a high-voltage MEMS biasing network. The network has a reset mode wherein a capacitive sensor is charged, and a functional mode wherein the MEMS biasing network provides a high impedance between the capacitive sensor and a bias voltage source. The network includes a high-voltage bus, a low-voltage bus, a ground bus, a biasing circuit, a sensor capacitor, and a control circuit. The high-voltage bus is configured to receive a high-voltage direct current (DC) power from a bias power source. The low-voltage bus configured to receive a low-voltage DC power for a low-voltage power source. The biasing circuit includes a first diode, an anode of the first diode coupled to the high-voltage bus, and a biasing field effect transistor (FET), a source of the biasing FET coupled to the high-voltage bus, and a drain of the biasing FET coupled to a cathode of the first diode. The sensor capacitor has a first node coupled to the drain of the biasing FET, and a second node coupled to the ground bus. The control circuit includes a first high-voltage standoff FET, a drain of the first high-voltage standoff FET coupled to a gate of the biasing FET, and a gate of the first high-voltage standoff FET coupled to the low-voltage bus, and a first control FET, a drain of the first control FET coupled to a source of the first high-voltage standoff FET, a source of the first control FET coupled to the ground bus, and a gate of the first control FET configured to receive a low-voltage control signal. When the low-voltage control signal is a logic one, the high-voltage MEMS biasing network is in the reset mode and the biasing FET charges the sensor capacitor, and when the low-voltage control signal is a logic low, the high-voltage MEMS biasing network is in the functional mode and the biasing FET provides a high impedance between the sensor capacitor and the bias voltage source.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Capacitive sensors (e.g., a MEMS microphone) are common, and use a bias voltage to operate. A biasing network operates to switch between a low impedance state, where a bias voltage is applied to the capacitive sensor to charge the capacitor, and a high impedance state, where the capacitive sensor is isolated from the bias voltage. The capacitive sensor operates when the biasing network is in the high impedance state.

Figure 1:
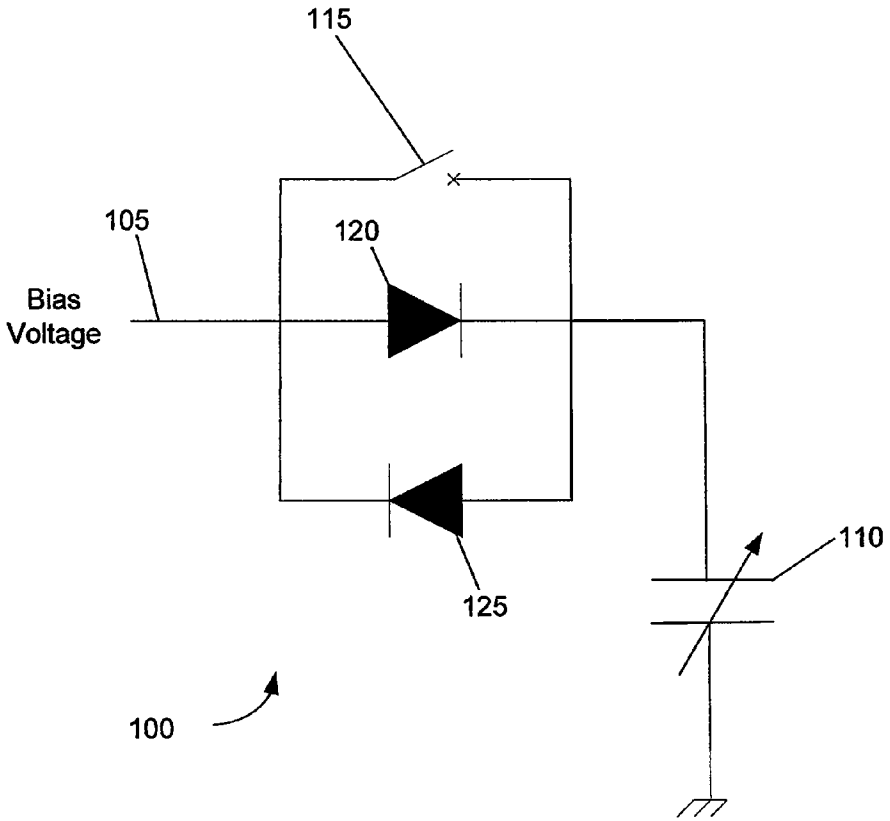
PRIOR ART Fig. 1
FIG. 1 is a schematic diagram of a prior art biasing network.

FIG. 1 shows a schematic diagram of a simple prior art MEMS biasing network 100. The network 100 receives a bias voltage at an input 105 from a power source, and couples the bias voltage to a capacitive sensor 110. The network 100 includes a switch 115, a first diode 120, and a second diode 125. An anode of the first diode 120 is coupled to a cathode of the second diode 125, and a cathode of the first diode 120 is coupled to an anode of the second diode 125. The switch 115 is coupled across the first and second diodes 120 and 125. The input 105 is coupled to the anode of the first diode 120, cathode of the second diode 125, and switch 115. The capacitive sensor 110 is coupled to the anode of the second diode 125, cathode of the first diode 120, and switch 115.

The network 100 initially is in a reset mode. In the reset mode, the switch 115 is closed and the capacitive sensor 110 charges up to the bias voltage. Once the capacitive sensor 110 is fully charged, the network 100 changes to a functional mode, and the switch 115 opens. The fact that the bias voltage and the charge of the capacitive sensor 110 are the same voltage results in the diodes 120 and 125 having a very high impedance, allowing the capacitive sensor 110 to operate.

If the impedance of the biasing network is not high enough in the high impedance state (functional mode), the frequency response of the sensor can suffer. In addition, the biasing network can produce noise which degrades a signal-to-noise ratio of the sensor. During the transition of the biasing network from low to high impedance (i.e., from reset mode to functional mode), noise at the bias generator output voltage or the sensor node can result in an undesirably slow time constant for the capacitive sensor. Accordingly, there needs to be minimal impact on the bias generator output voltage and the sensor node when transitioning from low to high impedance.

The concerns above are exacerbated when the capacitive sensor uses a high bias voltage (e.g., 100 volts direct current (DC) or more). The invention provides a biasing network for a MEMS capacitive sensor that is able to provide a high biasing voltage (e.g., 100 volts or more) to a MEMS capacitive sensor, where the impedance state of the biasing network is controlled by a low voltage control signal (e.g., about 5 volts, a CMOS level signal). In addition, the biasing network is produced using a standard CMOS process. The biasing network induces a relatively low transient voltage at the bias voltage source when transitioning from the low impedance state (i.e., reset) to the high impedance state (i.e., functional). The biasing network also has a sufficiently high impedance to low-pass filter noise from the bias voltage generator and the biasing network's own noise.

Figure 2:
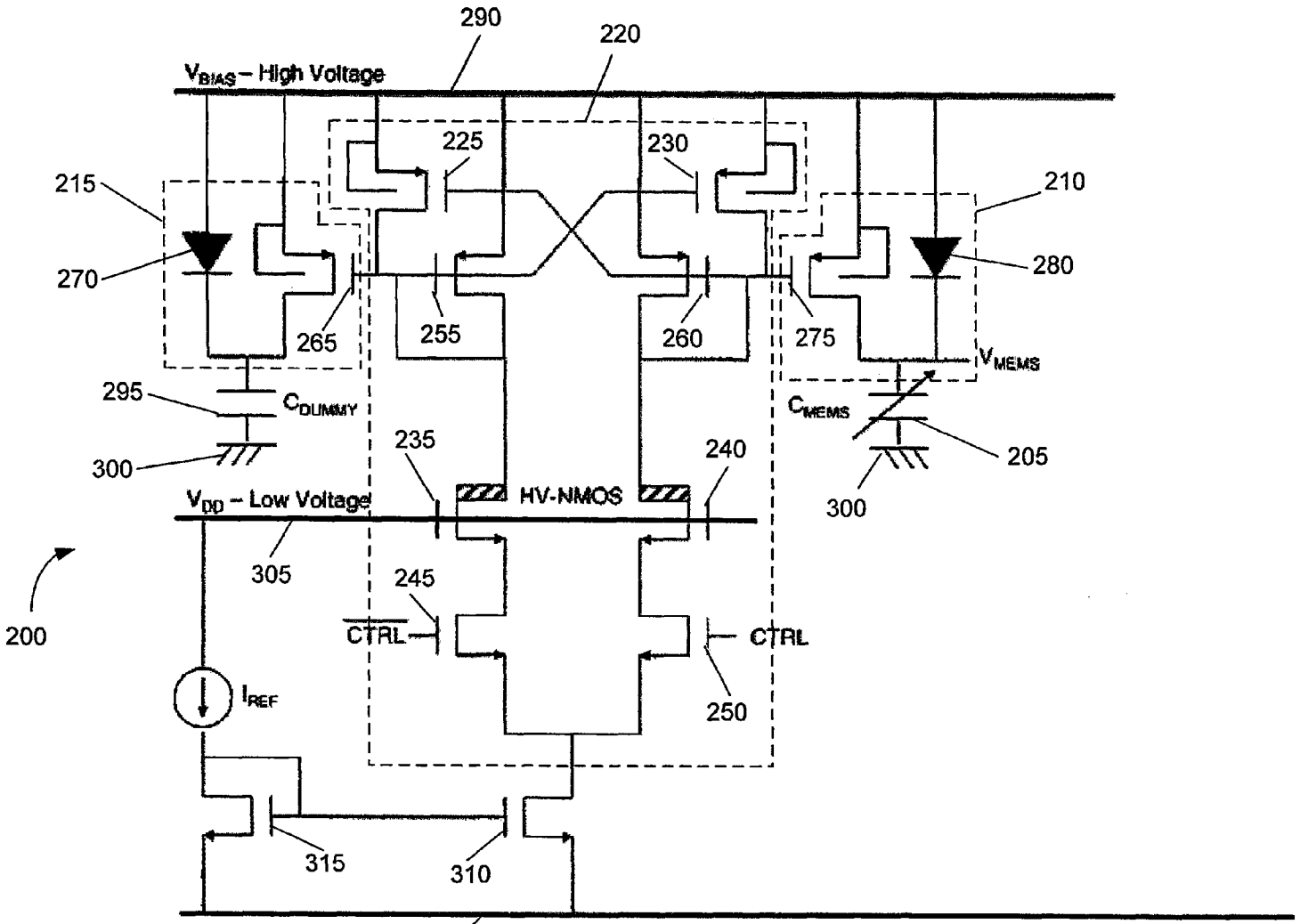
FIG. 2 is a schematic diagram of a high-voltage capable high impedance biasing network for capacitive sensors.

FIG. 2 shows a schematic diagram of a resettable, high-voltage capable high-impedance biasing network 200 for a MEMS capacitive sensor 205. In the embodiment shown, field effect transistors (FETs) are used. However, the invention contemplates the use of other types of switches (e.g., IGBTs). The network 200 includes a biasing circuit 210, a mirror circuit 215, and control circuit 220. The control circuit 220 includes a pair of latching field effect transistors (FET) 225 and 230, a pair of high-voltage standoff FETs 235 and 240, a pair of control FETs 245 and 250, and a pair of linking FETs 255 and 260. A first branch of the control circuit 220 includes control FET 250, high-voltage standoff FET 240, and linking FET 260. A second branch of the control circuit 220 includes control FET 245, high-voltage standoff FET 235, and linking FET 255. The mirror biasing circuit 215 includes a second biasing FET 265 and a second diode 270. The capacitive sensor biasing circuit 210 includes a biasing FET 275 and a diode 280.

A bias high-voltage line (or bus) 290 is configured to connect to a bias power source, and is coupled to the source connections of the biasing FETs 265 and 275, the latching FETs 225 and 230, and the linking FETs 255 and 260. The bias high-voltage line 290 is also coupled to the anodes of the diodes 270 and 280. The drain of the biasing FET 265 is coupled to the cathode of the diode 270 and also to a first node of a capacitor 295. A second node of the capacitor 295 is coupled to ground 300. The drain of the biasing FET 275 is coupled to the cathode of the diode 280 and also to a first node of the sensor capacitor 205. A second node of the sensor capacitor 205 is coupled to a ground bus 300.

The drain of latching FET 225 is coupled to the gates of biasing FET 265, linking FET 255, and latching FET 230. The drain of latching FET 225 is also coupled to the drain of linking FET 255, and the drain of high-voltage standoff FET 235. The drain of latching FET 230 is coupled to the gates of biasing FET 275, linking FET 260, and latching FET 225. The drain of latching FET 230 is also coupled to the drain of linking FET 260, and the drain of high-voltage standoff FET 240. The gates of high-voltage standoff FETs 235 and 240 are coupled to a low-voltage line (or bus) 305 (e.g., about 1.5 to 5.5 volts). The low-voltage line 305 is configured to connect to a low-voltage power source.

The source of high-voltage standoff FET 235 is coupled to the drain of control FET 245. The source of high-voltage standoff FET 240 is coupled to the drain of control FET 250. The sources of control FETs 245 and 250 are coupled to the drain of a FET 310. The source of FET 310 is coupled to ground 300. The drain of a FET 315 is coupled to the low voltage line 305, and to the gates of FETs 310 and 315. The source of FET 315 is coupled to ground 300.

The gate of control FET 250 receives a logic control signal, and the gate of control FET 245 receives an inverse of the logic control signal.

The network 200 is in the reset mode initially. In the reset mode, the control signal is a logic high (e.g., about 1.5 to about 5.5 volts DC). Thus, the gate of the control FET 250 is high, and the gate of the control FET 245 is low. The logic high on the gate of control FET 250 results in a reference current flowing through the high-voltage standoff FET 240 and the linking FET 260. Linking FET 260 and biasing FET 275 form a current mirror, this sources current onto the sensor capacitor 205 and charges the sensor capacitor 205 up to the bias voltage (e.g., a charging state).

At the same time, the logic low on control FET 245, along with latching FET 225, cause a branch including high-voltage standoff FET 235, linking FET 255, and biasing FET 265 to be shut off The network 200 transitions to functional mode when the control signal goes low. This causes a reference current to flow in the branch including control FET 245, high-voltage standoff FET 235, linking FET 255, and biasing FET 265. At the same time, the logic low on control FET 250, along with latching FET 230, cause a branch including high-voltage standoff FET 240, linking FET 260, and biasing FET 275 to be shut off. In this mode, biasing FET 275 has essentially zero gate-to-source voltage, and a body diode of the biasing FET 275 is in parallel with diode 280 (e.g., similar to diode 125 in FIG. 1). The balanced biasing circuits 210 and 215 allows the transition from low impedance (reset mode) to high impedance (functional mode or high impedance state) to occur with almost zero voltage disturbance to the MEMS node (i.e., the capacitive sensor 205) and the bias voltage generator.

In the embodiment shown, the biasing FETs 265 and 275, the latching FETs 225 and 230, and the linking FETs 255 and 260 are PMOS devices. The control FETS 245 and 250 and the FETs 310 and 315 are NMOS devices. The NMOS devices are low voltage, and are protected from the high voltage by the high-voltage standoff FETs 235 and 240. The PMOS devices are also low voltage devices; however, they reside in a high voltage NWELL. The NWELL stands off the high voltage with respect to ground.

Thus, the invention provides, among other things, a biasing network capable of providing high (e.g., 100) bias voltage controlled by CMOS logic voltage with minimal transient introduction, and sufficiently high impedance to low pass filter noise from the bias voltage generator and the biasing network itself. Various features and advantages of the invention are set forth in the following claims.

What is claimed is:

1. A high-voltage MEMS biasing network having a reset mode wherein a capacitive sensor is charged, and a functional mode wherein the MEMS biasing network provides a high impedance between the capacitive sensor and a bias voltage source, the network comprising:

a biasing circuit having a charging state and a high impedance state;

a mirror circuit having a charging state and a high impedance state; and a control circuit including a first branch that controls the biasing circuit and a second branch that controls the mirror circuit;

wherein the biasing network receives a logic control signal, the first branch puts the biasing circuit into the charging state when the logic control signal is a first logic signal and puts the biasing circuit into the high impedance state when the logic control signal is a second logic signal.

2. The network of claim 1, wherein the first logic signal is a logic high, and the second logic signal is a logic low.

3. The network of claim 2, wherein the logic low is a CMOS level signal.

4. The network of claim 2, wherein the logic high is a positive about one and a half volts DC to about five and a half volts DC, and the logic low is about zero volts DC.

5. The network of claim 1, wherein the mirror circuit is in the high impedance state when the biasing circuit is in the charging state.

6. The network of claim 1, wherein the mirror circuit is in the charging state when the biasing circuit is in the high impedance state.

7. The network of claim 1, wherein the mirror circuit and the biasing circuit work to reduce noise at the bias voltage source.

8. The network of claim 1, the first branch including a first control switch, a first high-voltage standoff switch, and a first latching switch, the second branch including a second control switch, a second high-voltage standoff, and a second latching switch.

9. A high-voltage MEMS biasing network having a reset mode wherein a capacitive sensor is charged, and a functional mode wherein the MEMS biasing network provides a high impedance between the capacitive sensor and a bias voltage source, the network comprising:

a high-voltage bus configured to receive a high-voltage direct current (DC) power from a bias power source;

a low-voltage bus configured to receive a low-voltage DC power for a low-voltage power source; a ground bus;

a biasing circuit comprising a first diode, an anode of the first diode coupled to the high-voltage bus, and a biasing field effect transistor (FET), a source of the biasing FET coupled to the high-voltage bus, and a drain of the biasing FET coupled to a cathode of the first diode;

a mirror FET, a source of the mirror FET coupled to the high-voltage bus, and a drain of the mirror FET coupled to a cathode of a second diode;

a sensor capacitor, a first node of the sensor capacitor coupled to the drain of the biasing FET, and a second node of the sensor capacitor coupled to the ground bus; and a control circuit comprising a first high-voltage standoff FET, a drain of the first high-voltage standoff FET coupled to a gate of the biasing FET, and a gate of the first high-voltage standoff FET coupled to the low-voltage bus, and a first control FET, a drain of the first control FET coupled to a source of the first high-voltage standoff FET, a source of the first control FET coupled to the ground bus, and a gate of the first control FET configured to receive a low-voltage control signal;

wherein when the low-voltage control signal is a logic one, the high-voltage MEMS biasing network is in the reset mode and the biasing FET charges the sensor capacitor, and when the low-voltage control signal is a logic low, the high-voltage MEMS biasing network is in the functional mode and the biasing FET provides a high impedance between the sensor capacitor and the bias voltage source.

10. The network of claim 9, further comprising a first linking FET, a drain of the first linking FET coupled to the drain of the first high-voltage standoff FET, a source of the first linking FET coupled to the high-voltage bus, and a gate of the first linking FET coupled to the gate of the biasing FET.

11. The network of claim 9, further comprising the second diode, an anode of the second diode coupled to the high-voltage bus;

a second capacitor, a first node of the second capacitor coupled to the drain of the mirror FET, and a second node of the second capacitor coupled to the ground bus;

a second high-voltage standoff FET, a drain of the second high-voltage standoff FET coupled to a gate of the mirror FET, and a gate of the second high-voltage standoff FET coupled to the low-voltage bus; and a second control FET, a drain of the second control FET coupled to a source of the second high-voltage standoff FET, a source of the second control FET coupled to the ground bus, and a gate of the second control FET configured to receive a second low-voltage control signal;

wherein the second low-voltage control signal is an inverse of the low-voltage control signal, and when the second low-voltage control signal is a logic one, the high-voltage MEMS biasing network is in the functional mode and the mirror FET charges the second capacitor, and when the second low-voltage control signal is a logic low, the high-voltage MEMS biasing network is in the reset mode and the mirror FET provides a high impedance between the second capacitor and the bias voltage source.

12. The network of claim 11, further comprising a second linking FET, a drain of the second linking FET coupled to the drain of the second high-voltage standoff FET, a source of the second linking FET coupled to the high-voltage bus, and a gate of the second linking FET coupled to the gate of the mirror FET.

13. The network of claim 12, further comprising a first latching FET, a source of the first latching FET coupled to the high-voltage bus, a drain of the first latching FET coupled to the gate of the biasing FET, and a gate of the first latching FET coupled to the gate of the mirror FET; and a second latching FET, a source of the second latching FET coupled to the high-voltage bus, a drain of the second latching FET coupled to the gate of the mirror FET, and a gate of the second latching FET coupled to the gate of the biasing FET;

wherein the first and second latching FETs operate to turn off the biasing FET when the low-voltage control signal is a logic one, and to turn off the mirror FET when the low-voltage control signal is a logic low.

14. The network of claim 13, wherein the biasing FET, the mirror FET, the first and second latching FETs, and the first and second linking FETs are low-voltage PMOS devices.

15. The network of claim 14, wherein the PMOS devices reside in a high-voltage NWELL.

16. The network of claim 15, wherein the high-voltage NWELL stands off the high voltage DC power with respect to ground.

17. The network of claim 11, wherein the first and second control FETs are low-voltage NMOS devices.

* * * * *